US011524307B2

(12) United States Patent
Riepe

(10) Patent No.: US 11,524,307 B2
(45) Date of Patent: Dec. 13, 2022

(54) SPRAYING DEVICE AND METHOD FOR ADJUSTING THE SPRAYING DEVICE

(71) Applicant: Bernd Riepe, Bünde (DE)

(72) Inventor: Bernd Riepe, Bünde (DE)

( * ) Notice: Subject to any disclaimer, the term of this patent is extended or adjusted under 35 U.S.C. 154(b) by 336 days.

(21) Appl. No.: 16/958,323

(22) PCT Filed: Dec. 19, 2018

(86) PCT No.: PCT/EP2018/085724

§ 371 (c)(1),
(2) Date: Jun. 26, 2020

(87) PCT Pub. No.: WO2019/154550

PCT Pub. Date: Aug. 15, 2019

(65) Prior Publication Data

US 2021/0060587 A1 Mar. 4, 2021

(30) Foreign Application Priority Data

Feb. 7, 2018 (DE) ..... 10 2018 102 737.0

(51) Int. Cl.
*B05B 1/30* (2006.01)

(52) U.S. Cl.
CPC ..... *B05B 1/3086* (2013.01)

(58) Field of Classification Search
CPC ..... B05B 1/3086; B05B 1/3452; B05B 1/12; B05B 1/341; B05B 1/3415; B05B 7/12
USPC ..... 239/11, 465, 479, 484, 292, 300, 341, 239/401
See application file for complete search history.

(56) References Cited

U.S. PATENT DOCUMENTS 1,982,055 A 11/1934 Jenkins
2,311,018 A * 2/1943 Bahnson, Jr. ..... B05B 7/066 239/118
3,690,557 A * 9/1972 Higgins ..... B29B 7/7438 239/416.1
3,698,644 A * 10/1972 Nystuen ..... D06F 43/002 239/526
4,219,532 A * 8/1980 Messervey ..... B05B 7/12 261/DIG. 26
4,534,512 A * 8/1985 Chow ..... B05B 1/1654 239/394

(Continued)

FOREIGN PATENT DOCUMENTS

CN 204901038 U 12/2015
DE 202005021103 U1 10/2007

(Continued)

OTHER PUBLICATIONS

Citation of Office Action created on Sep. 25, 2018 in related/corresponding DE Application No. 10 2018 102 737.0.

(Continued)

*Primary Examiner* — Justin M Jonaitis
(74) *Attorney, Agent, or Firm* — Patent Portfolio Builders PLLC

(57) ABSTRACT

A spraying device includes a spray head, which is connected to a supply line, via which a pressurized fluid can be conveyed. The spraying device includes a metering screw for influencing the fluid jet passing out of the spray head. The spraying device is designed such that a pointer element having at least one marking is connected to the metering screw in a rotationally fixed, yet detachable manner.

11 Claims, 2 Drawing Sheets

(56) References Cited

U.S. PATENT DOCUMENTS

| | | | | |
|---|---|---|---|---|
| 5,277,367 | A * | 1/1994 | Hsu | B05B 12/0026 239/300 |
| 8,066,204 | B2 * | 11/2011 | Petrovic | B05B 1/1618 239/443 |
| 2005/0189445 | A1 | 9/2005 | Hartle et al. | |
| 2011/0114749 | A1 * | 5/2011 | Munn | B05B 12/008 239/74 |
| 2016/0175861 | A1 * | 6/2016 | Gullicks | B05B 7/12 239/416.5 |
| 2019/0291122 | A1 * | 9/2019 | Cvetezar | E02D 35/005 |

FOREIGN PATENT DOCUMENTS

| | | | |
|---|---|---|---|
| DE | 102011000799 | A1 | 8/2012 |
| DE | 202016106913 | U1 | 10/2017 |
| WO | 2015088822 | A1 | 6/2015 |

OTHER PUBLICATIONS

International Search Report dated Apr. 10, 2019 in related/corresponding International Application No. PCT/EP2018/085724.
Written Opinion dated Apr. 10, 2019 in related/corresponding International Application No. PCT/EP2018/085724.
Office Action dated Oct. 11, 2022 in related/corresponding EP Application No. 18 829 813.7 (machine-generated translation).

* cited by examiner

SPRAYING DEVICE AND METHOD FOR ADJUSTING THE SPRAYING DEVICE

BACKGROUND AND SUMMARY OF THE INVENTION

The invention concerns a spraying device and a method for adjusting the spraying device.

Such spraying devices are used, for example, on woodworking machines to apply different fluids to a furniture panel at different processing points.

DE 20 2005 021 103 U1 discloses that such spraying devices are used to spray release agent onto the adjacent area of an edge of a furniture panel to be coated with an edging strip. The application of the release agent prevents glue or adhesive that emerges from a glue joint during edge coating from adhering to the furniture panel.

DE 10 2011 000 799 A1 describes that spraying devices are used to apply a coolant to a furniture panel.

Other fluids, such as cleaning agents or the like, are also applied to a furniture panel using such spraying devices. However, these fluids sometimes differ in their consistency, i.e., their viscosity, so that the respective fluid jet emerging from the spray head must be modified accordingly in order to achieve an optimum application result.

Until now, the fluid jet has been regulated directly at the point of use in such a way that an operator adjusts the metering screw so that a preferred amount of fluid emerges from the spray head. In this case, the adjustment of the metering screw is done exclusively according to visual perception, i.e., by sight.

Problems arise, however, if different operators adjust the spraying device at different intervals, as the amount of fluid applied is also different in this case due to subjective perception and evaluation.

In order to remedy this situation, DE 20 2016 106 913 U1 proposes to provide the shaft of the metering screw with markings. However, an exact adjustment, in particular a reproducible adjustment, is not possible with this method, as the thread beginnings of the metering screws are different due to the manufacturing process, i.e., with the same markings, there is a different adjustment stroke, so that the fluid jets emerging from the spray head differ from each other with regard to their application quantity.

Exemplary embodiments of the invention are directed to improving a spraying device in such a way that an exact adjustment of the fluid jet emerging from the spray head is reproducibly possible.

As a result of the invention, it is now possible to provide practically all spraying devices used in such a way that the same amount of fluid emerges from the spray head.

As has been shown, two positions of the metering screw are sufficient to spray the fluids used, i.e., the above-mentioned release agents, coolants, cleaning agents or similar, in optimum quantities despite their partially different viscosities.

In the method according to the invention, a first spray jet is set, matched to a specific fluid, by means of the metering screw before assembly of the spraying device, i.e., when the spraying device is completed at the factory. The adjustment of the spray jet can be carried out by observing the emerging fluid jet, preferably by suitable qualified personnel, or by suitable measuring procedures, as known from the prior art, for example a volume flow measurement.

After setting the optimum spray jet, the pointer element is attached to the metering screw in such a way that a first marking associated with the first spray jet is brought into alignment with a stationary correspondence part, for example on a housing accommodating the spray head and the metering screw. It is also conceivable to use the alignment of the nozzle head as the correspondence part.

The pointer element, which preferably consists of a small wheel mounted on a pin of the metering screw, is then connected to the metering screw in a rotationally fixed manner, preferably by means of a grub screw that is guided laterally through the small wheel and is supported by the pin of the metering screw in a frictionally engaged and/or positive manner. Other suitable locking devices are also conceivable, as are other forms of the pointer element, for example in the form of a bracket or the like. In any case, the pointer element must be connected firmly, i.e., in a rotationally fixed manner, to the metering screw.

As mentioned above, it has been shown in practice that for the fluids used, especially when used on a furniture panel, only two types of fluid need to be taken into account in terms of their composition, i.e., viscosity, when adjusting the metering screw, so that the metering screw only needs to assume two metering positions. These metering positions are known and correspond to a second marking on the pointer element, which is arranged at a predetermined angular distance therefrom.

When using the spraying device on a processing machine, the operator can adjust the metering screw in advance so that the spray jet corresponding to the fluid used emerges from the spray head in the specified metering quantity.

The markings themselves can be of different shapes and consist of numbers, letters, strokes or the like. Colored markings are also conceivable in order to make the distinction between the two aforementioned metering levels recognizable.

The fact that an exact setting of the spraying devices for their operation is practically predetermined also results in economic advantages, as the fluid now emerges from the spray head in an optimized quantity, i.e., neither too much nor too little. In the first case, the consumption costs are reduced accordingly and in the second case, incorrect processing is avoided, so that costly reworking is avoided.

BRIEF DESCRIPTION OF THE DRAWING FIGURES

An embodiment example is described below using the attached drawings, wherein.

DETAILED DESCRIPTION

Figure 1:
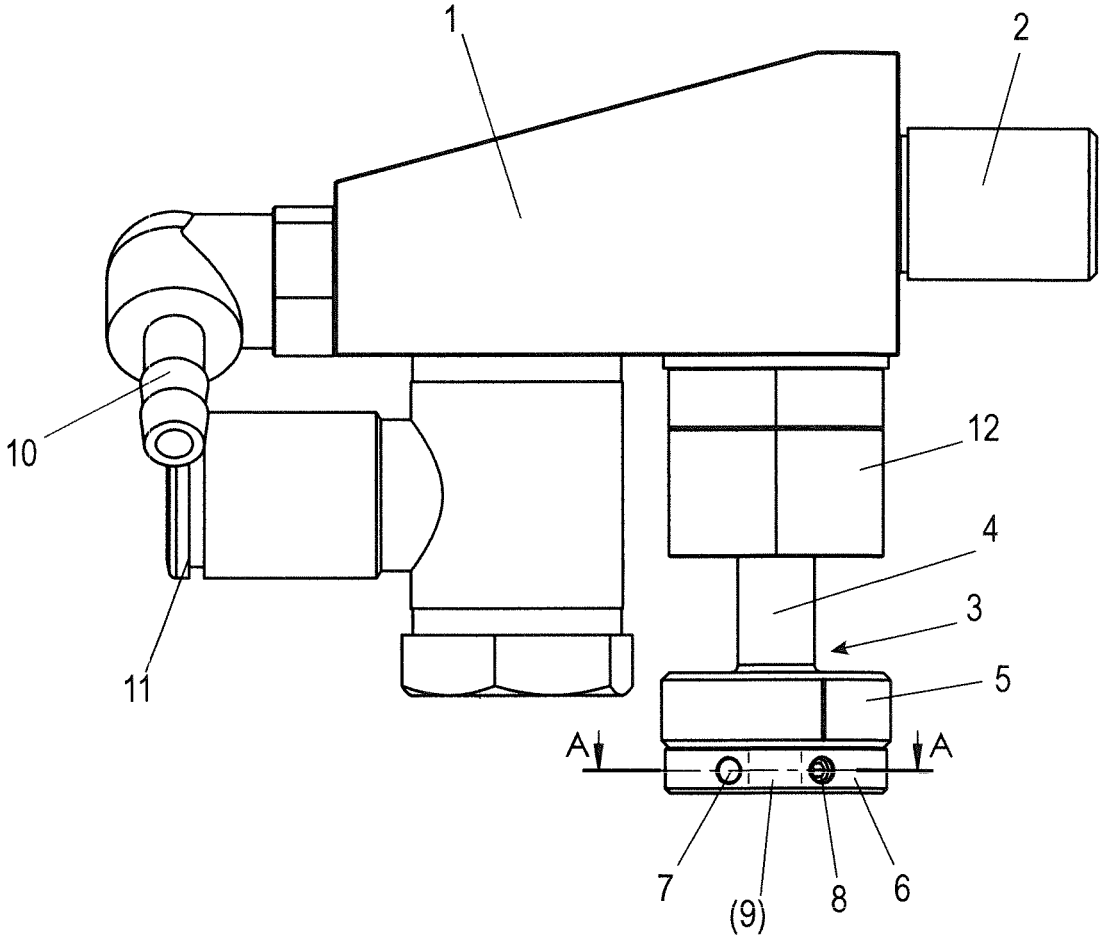
FIG. 1 shows a spraying device according to the invention in a side view.

The figures show a spraying device, having a housing 1 to which a spray head 2 is attached, which is connected in the housing 1 via a supply line not shown, via which a pressurized fluid can be guided to the spray head 2, wherein the spraying device in the embodiment example shown is designed in the manner of an injector nozzle, with a fluid connection 10 and a compressed air connection 11, so that the fluid is guided under pressure through a channel 13 (FIG. 3) of the spray head 2 and emerges as a spray jet. It is understood that other systems of fluid supply are also conceivable, which do not function according to the principle of an injector nozzle.

To influence the fluid jet emerging from the spray head 2, a metering screw 3 is screwed into a nut part 12 of the housing 1 in an adjustable manner, which has a threaded shaft 4 and a head 5 thickened relative thereto.

Figure 3:
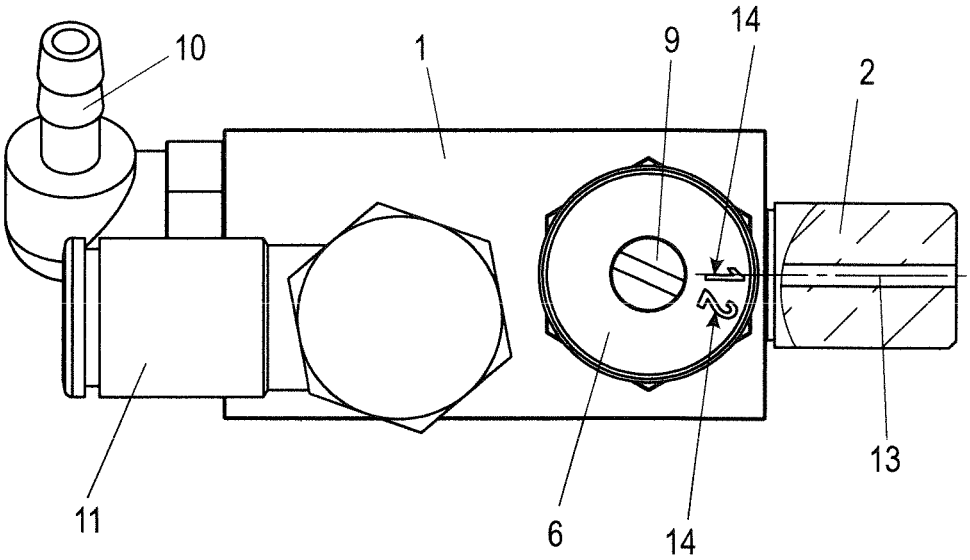
FIG. 3 shows the spraying device in a partially intersected top view.

According to the invention, a pointer element 6 is arranged at the metering screw 3, which is connected thereto in a rotationally fixed but detachable manner, which is provided with two markings 14, as can be seen particularly clearly in FIG. 3, and which consists of a small wheel whose diameter corresponds approximately to the diameter of the head 5.

The two markings 14, which are formed by digits, are arranged on the visible base surface and each represent a position of the metering screw 3 in which an optimized fluid jet emerges from the channel 13 of the spray head 2, wherein each marking 14 is provided for a specific property, in particular a viscosity of the fluids.

Figure 2:
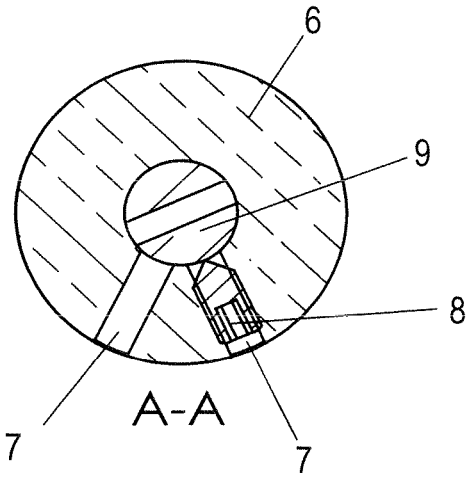
FIG. 2 shows a section through a part of the spraying device according to line A-A in FIG. 1.

To prevent the pointer element 6, which is shown in FIG. 2 in a cross section, from rotating, the pointer element 6 is pushed onto a pin 9 of the metering screw 3 and clamped to it by means of a grub screw 8, which is inserted laterally into a hole 7 of the pointer element 6 and contacts the pin 9 with its tip. The grub screw 8 can be screwed in a self-tapping manner into the smooth hole 7 of the pointer element 6 which consists of plastic.

In FIG. 3 it can be seen that one of the markings 14 is aligned with the channel 13, which thus forms a correspondence part, which is not visible from the outside, but can be assumed without any problems, wherein here the first marking 14 represents the position in which a first fluid is sprayed from the channel 13 in a precisely adjusted manner.

After turning the metering screw 3 and thus the pointer element 6, which is held thereon in a rotationally fixed manner, counterclockwise to a position in which the second marking 14 is aligned with the channel 13, i.e., aligned with the axis of the spray head 2, the spraying device is ready for the optimum application of a second fluid, if this is connected to the fluid connection 10.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Housing
2 Spray head
3 Metering screw
4 Threaded shaft
5 Head
6 Pointer element
7 Hole
8 Grub screw
9 Pin
10 Fluid connection
11 Compressed air connection
12 Nut part
13 Channel
14 Marking

The invention claimed is:

1. A spraying system, comprising:

a spray head;

a supply line connected to the spray head, wherein a pressurized working fluid is guidable via the supply line;

a metering screw configured to influence a fluid jet emerging from the spray head, wherein the metering screw includes a first position for a first pressurized working fluid having a first viscosity and a second position for a second pressurized working fluid having a second viscosity, which is different from the first viscosity, wherein an amount of the first pressurized working fluid emerging from the spray head as the fluid jet when the metering screw is in the first position is a same amount as an amount of the second pressurized working fluid emerging from the spray head as the fluid jet when the metering screw is in the second position; and a pointer element having at least first and second markings corresponding to the first and second positions, wherein the pointer element is connected to the metering screw in a rotationally fixed, but detachable manner, wherein the pressurized working fluid is the first pressurized working fluid or the second pressurized working fluid.

2. The spraying system of claim 1, wherein the first marking is aligned with a stationary correspondence part in the first position and the second marking is aligned with the stationary correspondence part in the second position.

3. The spraying system of claim 1, wherein the pointer element is a wheel, and the marking is arranged on a visible base surface of the wheel, associated with an edge region.

4. The spraying system of claim 3, wherein, on a side of the metering screw facing the pointer element, the metering screw has a pin onto which the wheel is fitted.

5. The spraying system of claim 1, wherein the pointer element is held in a frictionally engaged or positive manner on the metering screw.

6. The spraying system of claim 4, wherein the pointer element is fixed to the metering screw by a laterally inserted grub screw that engages on the pin.

7. The spraying system of claim 1, wherein the first and second markings are arranged at a predetermined angular distance from each other.

8. The spraying system of claim 1, wherein the first and second markings includes numbers, letters, or strokes.

9. The spraying system of claim 1, wherein the first marking is aligned with a central axis of the spray head in the first position and the second marking is aligned with the central axis of the spray head in the second position.

10. A method for adjusting the spraying system of claim 1, the method comprising:

monitoring, while the first or second pressurized working fluid is guided via the supply line to the spray head, the fluid jet emerging from the spray head, wherein the monitoring is a visual check of the fluid jet or a measurement of the fluid jet;

adjusting the metering screw to optimize fluid discharge of the fluid jet based on the viscosity of the first or second pressurized working fluid;

connecting the pointer element to the metering screw in the rotationally fixed, but detachable manner; and aligning the at least one marking with a stationary correspondence part of the spraying system.

11. The system of claim 1, wherein the pointer element has only first and second markings.

* * * * *